US007019236B2

(12) United States Patent
Dove

(10) Patent No.: US 7,019,236 B2
(45) Date of Patent: Mar. 28, 2006

(54) SWITCH WITH LID

(75) Inventor: Lewis R. Dove, Monument, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/799,006

(22) Filed: Mar. 11, 2004

(65) Prior Publication Data

US 2005/0199480 A1 Sep. 15, 2005

(51) Int. Cl.
*H01H 29/00* (2006.01)

(52) U.S. Cl. ..... 200/182; 200/292

(58) Field of Classification Search ..... 200/181, 200/182, 185, 188, 190–194, 198, 199, 214, 200/220–224, 233–236, 292, 506
See application file for complete search history.

(56) References Cited

U.S. PATENT DOCUMENTS

| | | | | |
|---|---|---|---|---|
| 6,255,730 | B1 | 7/2001 | Dove et al. | |
| 6,323,447 | B1 | 11/2001 | Kondoh et al. | |
| 6,457,979 | B1 | 10/2002 | Dove et al. | |
| 6,781,075 | B1 * | 8/2004 | Dove et al. | 200/182 |
| 6,818,844 | B1 * | 11/2004 | Wong et al. | 200/182 |
| 6,822,176 | B1 * | 11/2004 | Fazzio | 200/182 |
| 6,872,903 | B1 * | 3/2005 | Takenaka et al. | 200/182 |
| 6,894,237 | B1 * | 5/2005 | Wong et al. | 200/182 |
| 6,903,287 | B1 * | 6/2005 | Wong | 200/182 |

OTHER PUBLICATIONS

Marvin Glenn Wong, et al., "Formation of Signal Paths to Increase Maximum Signal-Carrying Frequency of a Fluid-Based Switch", U.S. Appl. No. 10/413,855, filed Apr. 14, 2003.

Marvin Glenn Wong, "A Piezoelectrically Actuated Liequid Metal Switch", U.S. Appl. No. 10/137,691, filed May 2, 2002.

Casey et al., "Methods for Making Microwave Circuits", U.S. Appl. No. 10/600,143, filed Jun. 19, 2003.

Casey et al., Methods for Depositing a Thickfilm Dielectric on a Substrate, U.S. Appl. No. 10/600,600, filed Jun. 19, 2003.

Lewis R. Dove, "Switch, with Lid Mounted on a Thickfilm Dielectric", U.S. Appl. No. (not yet assigned), 18 pages of specification including claims and abstract, six- (6) sheets of drawings, filed Mar. 11, 2004.

* cited by examiner

*Primary Examiner*—Michael A. Friedhofer

(57) ABSTRACT

A switch includes a switching element, a substrate, and a lid. The substrate has internal and external metal layers separated by at least an insulating layer. The substrate's external metal layer has a first plurality of signal conductors formed therein, at least some of which are in contact with the switching element. The substrate's internal metal layer has a second plurality of signal conductors formed therein, which are electrically coupled to the first plurality of signal conductors by means of a first plurality of conductive vias in the insulating layer. The lid is attached to the substrate to encapsulate the first plurality of signal conductors between the lid and the substrate.

20 Claims, 8 Drawing Sheets

SWITCH WITH LID

BACKGROUND

Fluid-based switches such as liquid metal micro switches (LIMMS) have proved to be valuable in environments where fast, clean switching is desired. However, the physical construction of a fluid-based switch sometimes limits its mission electrical performance (e.g., the frequencies at which signals propagate through the switch, or the cleanliness of signals that are output from the switch). Any development that preserves the beneficial switching characteristics of a fluid-based switch, but also increases its mission electrical performance, is therefore desirable.

SUMMARY OF THE INVENTION

One aspect of the invention is embodied in a switch. The switch comprises a switching element, a substrate, and a lid. The substrate comprises internal and external metal layers separated by at least an insulating layer. The substrate's external metal layer comprises a first plurality of signal conductors, at least some of which are in contact with the switching element. The substrate's internal metal layer comprises a second plurality of signal conductors, electrically coupled to the first plurality of signal conductors by means of a first plurality of conductive vias in the insulating layer. The lid is attached to the substrate to encapsulate the first plurality of signal conductors between the lid and the substrate.

Another aspect of the invention is also embodied in a switch. The switch comprises first and second mated substrates defining therebetween at least portions of a number of cavities. The first substrate comprises first and second metal layers separated by at least an insulating layer. A switching fluid is held within one or more of the cavities, and is movable between at least first and second switch states in response to forces that are applied to it. A lid is attached to the first metal layer and covers at least a portion of the second substrate. A first plurality of signal conductors is formed in the first metal layer, the conductors of which are in contact with the switching fluid. A second plurality of signal conductors is formed in the second metal layer and extends under the lid. The second plurality of signal conductors is electrically coupled to the first plurality of signal conductors by means of a plurality of conductive vias formed in the insulating layer.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

As indicated in the Background, supra, fluid-based switches can provide fast, clean switching. However, the physical construction a fluid-based switch often impacts its mission electrical performance (e.g., the frequencies at which signals propagate through the switch, or the cleanliness of signals that are output from the switch).

One physical aspect of a fluid-based switch that impacts the switch's mission electrical performance is the routing of its conductors. Typically, a fluid-based switch comprises first and second mated substrates that define therebetween a number of cavities holding a switching fluid. A plurality of signal conductors extend from the cavities holding the switching fluid, and other conductors extend to elements used in changing the state of the switching fluid. By routing the conductors through vias in one of the mated substrates, to external solder balls formed on one of the substrates, the conductors are "out of the way" so that the switch can be covered by a metallic enclosure. The metallic enclosure is important in that it insulates the switch and its conductors from electrical and magnetic interference and provides an environment in which electrical impedance and magnetic fields may be more closely controlled. However, by routing a switch's conductors through vias, each conductor is required to make at least a pair of right-angle turns. These turns limit the mission electrical performance of the switch. Although the turns can be eliminated by routing planar conductors to the elements of the switch, the routing of planar conductors on the surface of one of the mated substrates tends to interfere with the encapsulation of the switch in a metallic enclosure. New means for shielding switches from electrical and magnetic interference, or for other purposes, are therefore needed.

Figure 1:
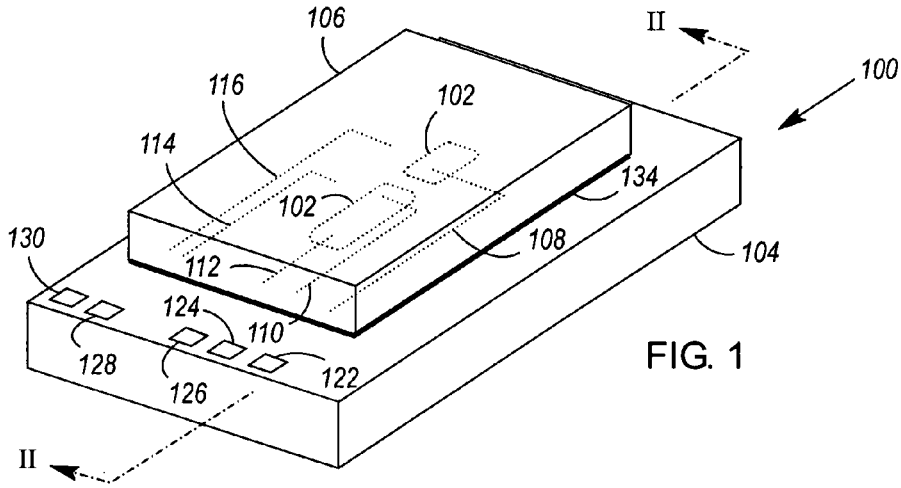
FIG. 1 illustrates a first exemplary embodiment of a switch.
Figure 2:
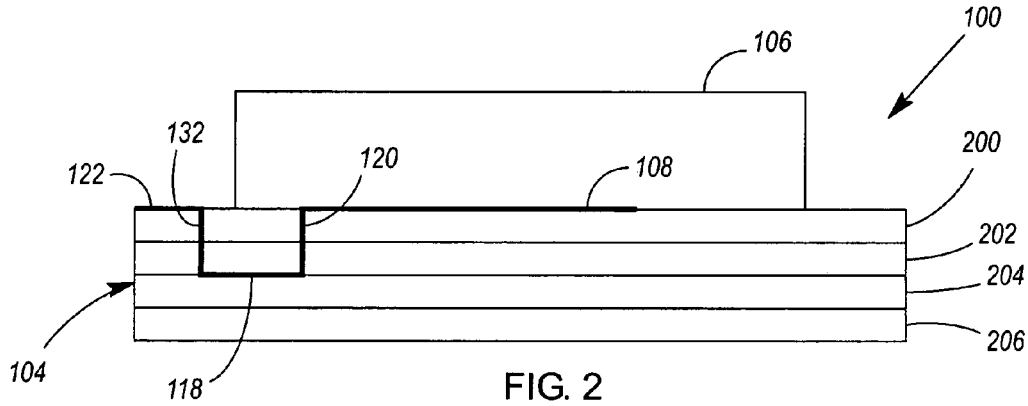
FIG. 2 illustrates a cross-section of the switch shown in FIG. 1.
Figure 3:
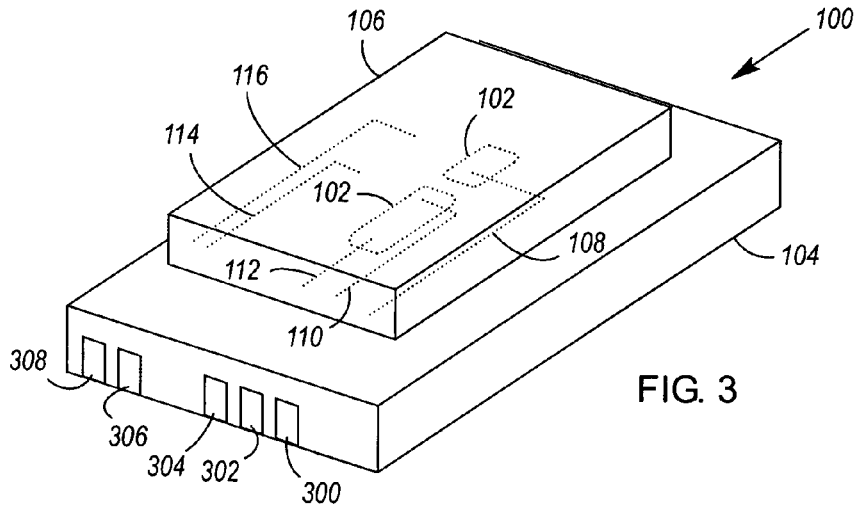
FIG. 3 illustrates an alternate embodiment of the FIG. 1 switch, wherein the switch is provided with edge contacts.
Figure 6:
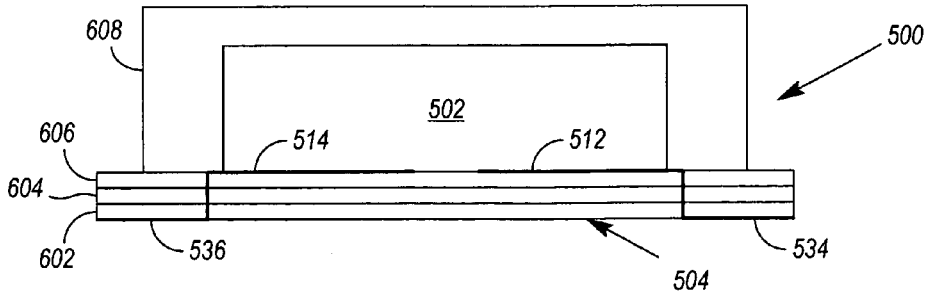
FIG. 6 illustrates a cross-section of the layers of the FIG. 5 switch.

FIG. 1 illustrates a first exemplary embodiment of a switch 100. The switch 100 comprises a switching fluid 102, a substrate 104, and a lid 106. As shown in FIGS. 1–3, the lid 106 may serve to help contain the switching fluid 102; or, as shown in FIG. 6, a lid 608 might encapsulate another element (e.g., channel plate 502) that contains the switching fluid.

The substrate 104 comprises internal and external metal layers 204, 200 (see FIG. 2 cross-section) separated by at least an insulating layer 202 (but possibly separated by other insulating and metallic layers). An additional insulating layer 206 lies below the internal metal layer 204. The substrate's external metal layer 200 comprises a first plurality of signal conductors 108, 110, 112, 114, 116, at least some of which are in contact with the switching fluid 102. The substrate's internal metal layer 204 comprises a second plurality of signal conductors (e.g., conductor 118, FIG. 2) that are electrically coupled to the first plurality of signal conductors 108–116 by means of a first plurality of conductive vias (e.g., via 120, FIG. 2) in the insulating layer 202. The lid 106 is attached to the substrate 104 to encapsulate the first plurality of signal conductors 108–116 between the lid 106 and the substrate 104.

Optionally, the external metal layer 200 may comprise a plurality of contacts 122, 124, 126, 128, 130, exterior to the lid 106 and coupled to the second plurality of signal conductors (e.g., conductor 118) via a plurality of conductive vias (e.g., via 132) in the insulating layer 202. Alternately, as shown in FIG. 3, the second plurality of signal conductors may extend to edge contacts 300, 302, 304, 306, 308 of switch 100 without resurfacing on external metal layer 200.

As disclosed in the U.S. patent application of Marvin Glenn Wong, et al. entitled "Formation of Signal Paths to Increase Maximum Signal-Carrying Frequency of a Fluid-Based Switch" (Ser. No. 10/413,855 filed Apr. 14, 2003; hereby incorporated by reference), the maximum switching frequency of a switch 100 may be increased if the signal paths of such a switch are substantially planar. The switches 100, 300 illustrated in FIGS. 1–3 attempt to incorporate this principle, but for where the signal paths drop under lid 106. Preferably, however, the drops in the signal paths are made small to limit their impact on the signal paths. The use of lid 106 is advantageous in that it provides shielding for the conductors 108–116, switching fluid 102, and other components, if any, of switch 100. Also, the lid 106 may be bonded to the thickfilm dielectric 118 in such a manner that a hermetic seal is formed. The combination of 1) limiting the drops of vias, and 2) enclosing switch components within the lid 106, tends to improve the mission electrical performance of the switch 100 (e.g., the frequencies at which signals propagate through the switch, or the cleanliness of signals that are output from the switch).

In one embodiment of switch 100, the lid 106 is conductive (e.g., metallic) and is attached to a ground trace 134 formed in the external metal layer 200 of the substrate 104. The ground trace 134 may follow the perimeter of the lid 106, as shown, but need not. For example, the lid 106 could be attached to the ground trace 134 at an intersection of the lid 106 and the ground trace 134, but could otherwise be attached to non-grounded even non-conductive portions of the external metal layer 200. The lid 106 could also be attached entirely to non-grounded or non-conductive portions of the external metal layer 200, and then attached to the ground trace 134 by means of a wire.

In another embodiment of switch 100, the lid 106 is made from a number of glass or ceramic layers that are bonded to one another.

By way of example, the lid 106 may be attached to the ground trace 134 via solder or a conductive adhesive. Or, if the lid 106 is glass or ceramic, the lid 106 may be attached to the substrate 104 via an adhesive.

Figure 4:
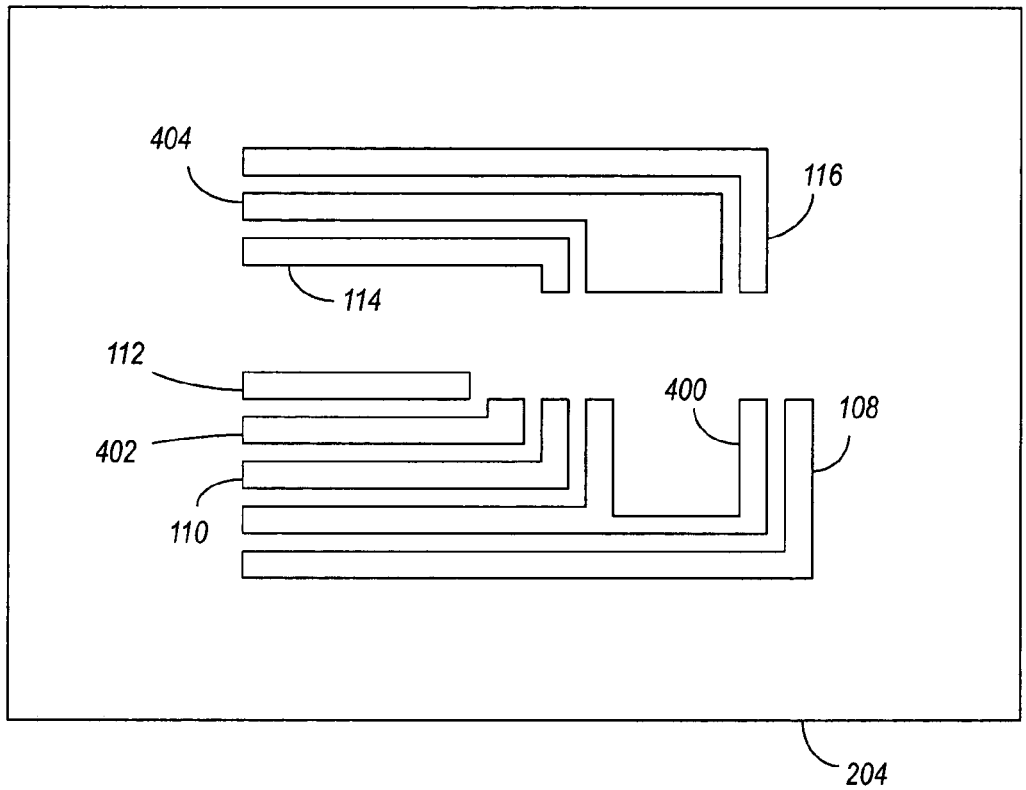
FIG. 4 is a plan view of the external metal layer of the FIG. 1 switch.

To provide even more electrical isolation for the circuitry of switch 100, the external metal layer 200 of switch 100 may comprise a number of ground conductors 400, 402, 404 (FIG. 4) adjacent sides of the first plurality of signal conductors 108–116 (or adjacent at least those conductors 108–112 that are in contact with the switching fluid 102). The ground conductors 400–404, in combination with the signal conductors 108–112, form coplanar transmission-line structures. In one embodiment of switch 100, the lid 106 is conductive, and the ground conductors 400–404 are electrically coupled to it.

Figure 7:
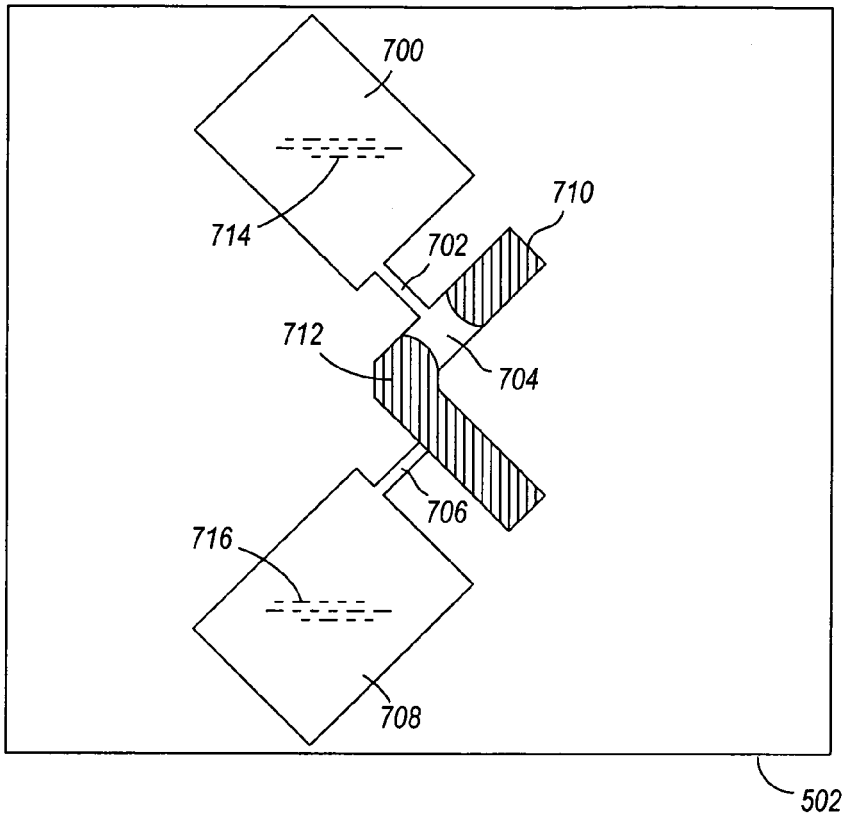
FIG. 7 is a first plan view of the channel plate of the FIG. 5 switch.

FIGS. 5–9 illustrate a second exemplary embodiment of a switch 500. The switch 500 comprises first and second mated substrates 502, 504 that define therebetween at least portions of a number of cavities 700, 702, 704, 706, 708 (FIG. 7). As shown, the substrate 502 may take the form of a channel plate, and one or more of the cavities may be at least partly defined by a switching fluid channel 710 in the channel plate 502. The remaining portions of the cavities 700–708, if any, may be defined by the substrate 504 that is mated and sealed to the channel plate 502. See FIG. 6.

The channel plate 502 and substrate 504 may be sealed to one another by means of an adhesive, gasket, screws (providing a compressive force), and/or other means. One suitable adhesive is Cytop™ (manufactured by Asahi Glass Co., Ltd. of Tokyo, Japan). Cytop™ comes with two different adhesion promoter packages, depending on the application. When a channel plate 502 has an inorganic composition, Cytop™'s inorganic adhesion promoters should be used. Similarly, when a channel plate 502 has an organic composition, Cytop™'s organic adhesion promoters should be used.

As shown in FIG. 6, a lid 608 is attached to a first metal layer 606 of the substrate 504. The lid 608 covers at least a portion of the channel plate 502.

Figure 5:
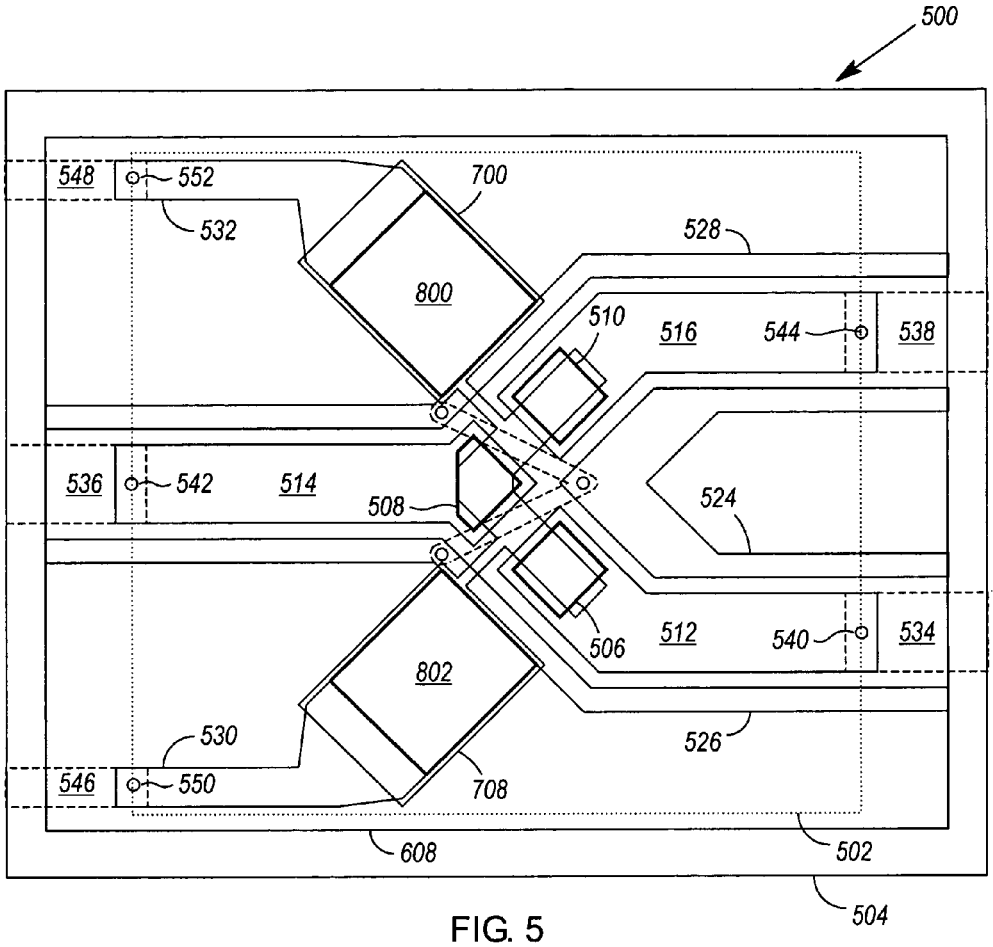
FIG. 5 is a plan view of a second exemplary embodiment of a switch.
Figure 8:
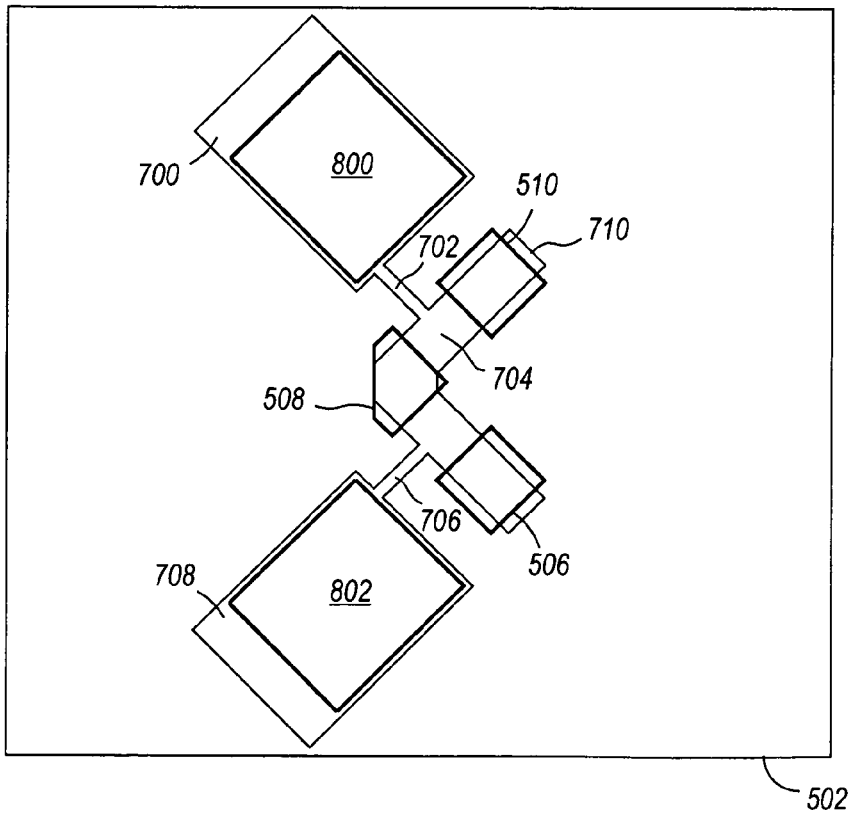
FIG. 8 is a second plan view of the channel plate of the FIG. 5 switch.

As shown in FIG. 7, a switching fluid 712 (e.g., a conductive liquid metal such as mercury) is held within the cavity 704 defined by the switching fluid channel 710. The switching fluid 712 is movable between at least first and second switch states in response to forces that are applied to the switching fluid 712. FIG. 7 illustrates the switching fluid 712 in a first state. In this first state, there is a gap in the switching fluid 712 in front of cavity 702. The gap is formed as a result of forces that are applied to the switching fluid 712 by means of an actuating fluid 714 (e.g., an inert gas or liquid) held in cavity 700. In this first state, the switching fluid 712 wets to and bridges contact pads 506 and 508 (FIGS. 5 & 8). The switching fluid 712 may be placed in a second state by decreasing the forces applied to it by means of actuating fluid 714, and increasing the forces applied to it by means of actuating fluid 716. In this second state, a gap is formed in the switching fluid 712 in front of cavity 706, and the gap shown in FIG. 7 is closed. Also in this second state, the switching fluid 712 wets to and bridges contact pads 508 and 510 (FIGS. 5 & 8).

Figure 9:
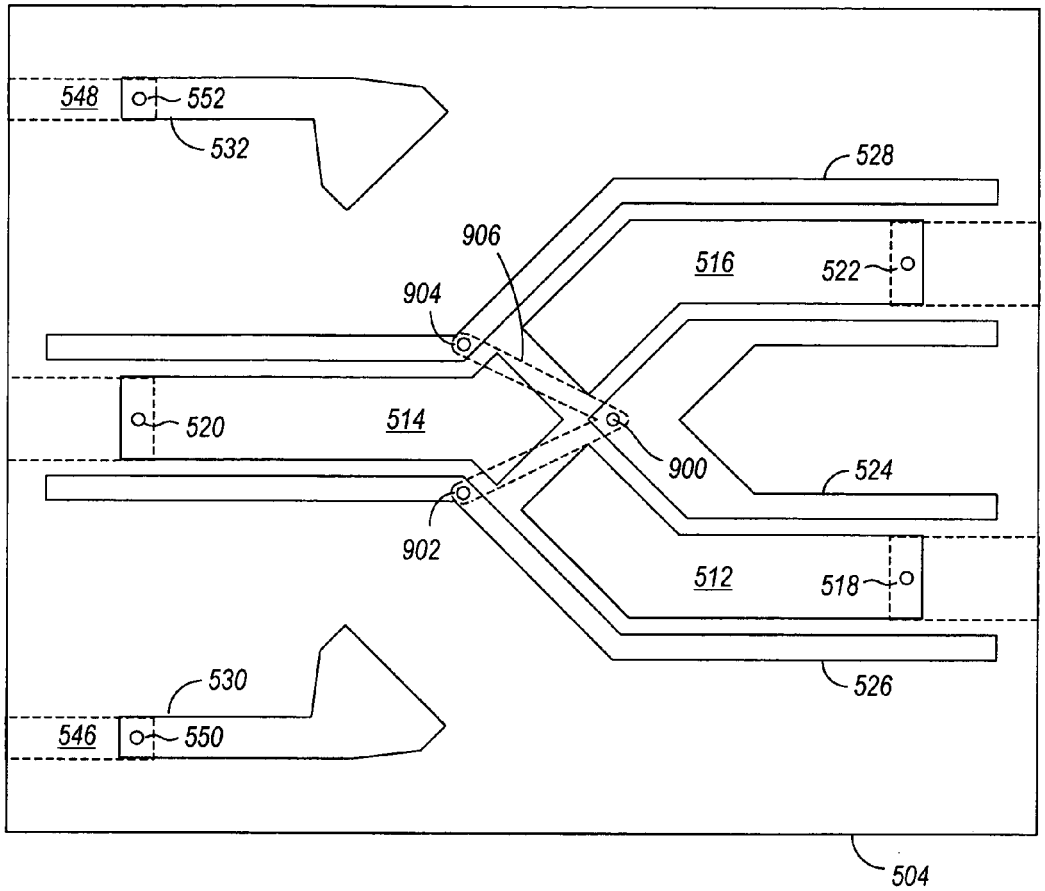
FIG. 9 is a plan view of the substrate of the FIG. 5 switch.

As shown in FIGS. 5 & 9, a first plurality of signal conductors 512, 514, 516 are formed in a first metal layer 606 of the substrate 504. Each of the first plurality of signal conductors 512–516 extend from points interior to the lid 608 to within the one or more cavities 704 holding the switching fluid 712. When the switch 500 is assembled, these conductors 512–516 are in wetted contact with the switching fluid 712. The ends 506–510 of the planar signal conductors 512–516 to which the switching fluid 712 wets may be plated (e.g., with Gold or Copper), but need not be.

A second plurality of signal conductors 534, 536, 538 are formed in a second metal layer 602 of the substrate 504. These conductors 534–538 are then coupled to corresponding ones of the first conductors by means of vias 540, 542, 544 formed in an insulating layer 604 that separates the first and second metal layers 606, 602. The conductors 534–538 may extend under the lid 608 so that they may serve as external contacts for the switch 500. Alternately, the conductors 534–538 may be coupled to vias that couple the conductors 534–538 to a plurality of contacts that are positioned exterior to the lid 608 and on the surface of metal layer 606 (similarly to the arrangement shown in FIG. 2).

Although FIG. 6 shows the first and second metal layers 606, 602 as surface layers of the substrate 504, they need not be surface layers. Furthermore, the substrate 504 may comprise additional metal and insulating layers, with the first and second metal layers 602, 606 being separated by any number of intermediate layers.

To further facilitate high speed propagation through the switch 500, a number of planar ground conductors 524, 526, 528 may be formed adjacent either side of each planar signal conductor 512–516 (FIGS. 5 & 9). The planar signal and ground conductors 512–516, 524–528 form a coplanar transmission-line structure for signal routing, and 1) provide better impedance matching, and 2) reduce signal radiation at higher frequencies. In one embodiment, the planar ground conductors 524–528 are electrically coupled to the lid 608 by means of solder or conductive adhesive.

As shown in FIGS. 5 & 9, a single ground conductor may bound the sides of more than one of the signal conductors 512–516 (e.g., ground conductor 524 bounds sides of signal conductors 512 and 516). Furthermore, the ground conductors 524–528 may be coupled to one another within the switch 500 for the purpose of achieving a uniform and more consistent ground. If the substrate 504 comprises alternating metal and insulating layers 602–606 (FIG. 6), then the ground conductors 524–528 may be formed in a first metal layer 606, and may be coupled to a V-shaped trace 906 in a second metal layer 602 by means of a number of conductive vias 900, 902, 904 formed in an insulating layer 604.

Figure 10:
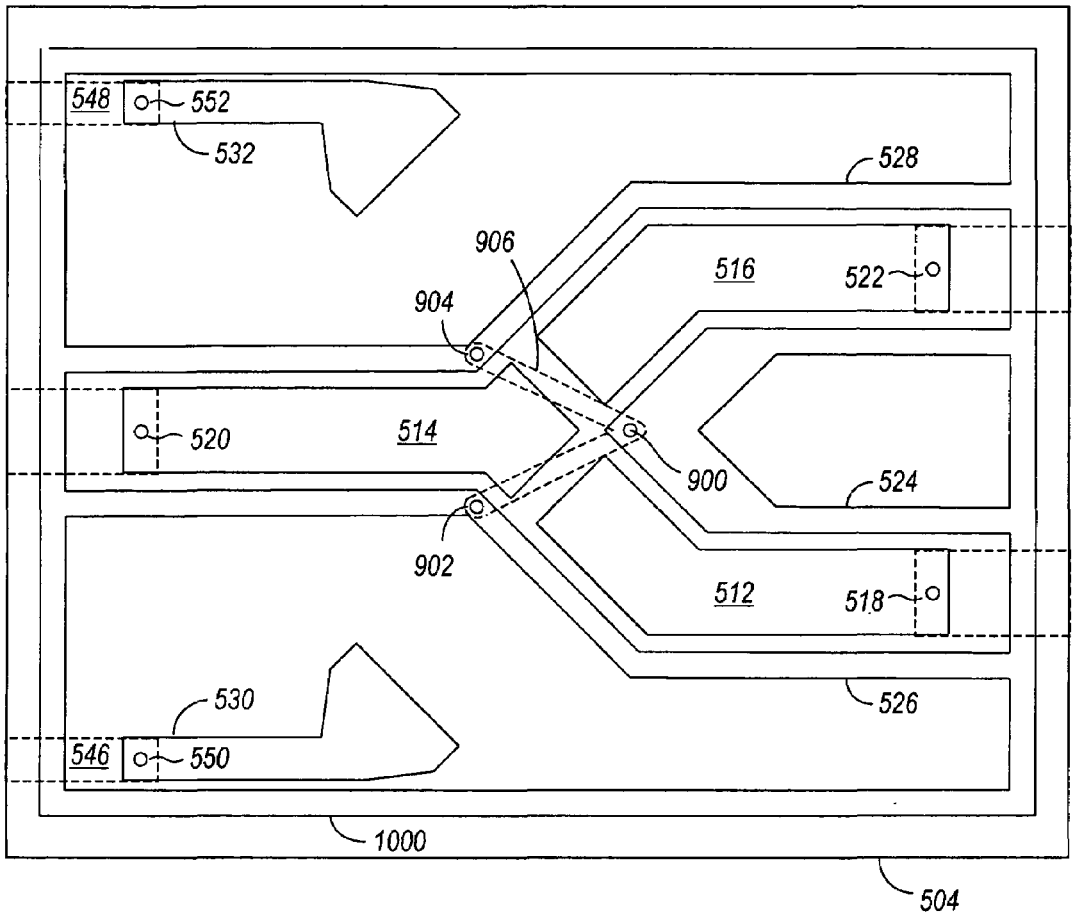
FIG. 10 is a plan view illustrating a ground trace provided on the substrate of the FIG. 5 switch.

As shown in FIG. 10, the lid 608 may be coupled (e.g., soldered or bonded with conductive adhesive) to a ground trace 1000 formed in the first metal layer 606. The ground trace 1000 may follow the perimeter of the lid 608, as shown, or may intersect the lid 608 at one or more points. In one embodiment, the planar ground conductors 524–528 are coupled to the lid 608 via the ground trace 1000. In another embodiment, the lid 608 may simply be glued to the substrate 504 using an adhesive.

In the prior description, it was disclosed that switching fluid 712 could be moved from one state to another by forces applied to it by an actuating fluid 714, 716 held in cavities 700, 708. However, it has yet to be disclosed how the actuating fluid 714, 716 is caused to exert a force (or forces) on switching fluid 712. One way to cause an actuating fluid (e.g., actuating fluid 714) to exert a force is to heat the actuating fluid 714 by means of a heater resistor 800 that is exposed within the cavity 700 that holds the actuating fluid 714. As the actuating fluid 714 is heated, it tends to expand, thereby exerting a force against switching fluid 712. In a similar fashion, actuating fluid 716 can be heated by means of a heater resistor 802. Thus, by alternately heating actuating fluid 714 or actuating fluid 716, alternate forces can be applied to the switching fluid 712, causing it to assume one of two different switching states. Additional details on how to actuate a fluid-based switch by means of heater resistors are described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference.

Figure 11:
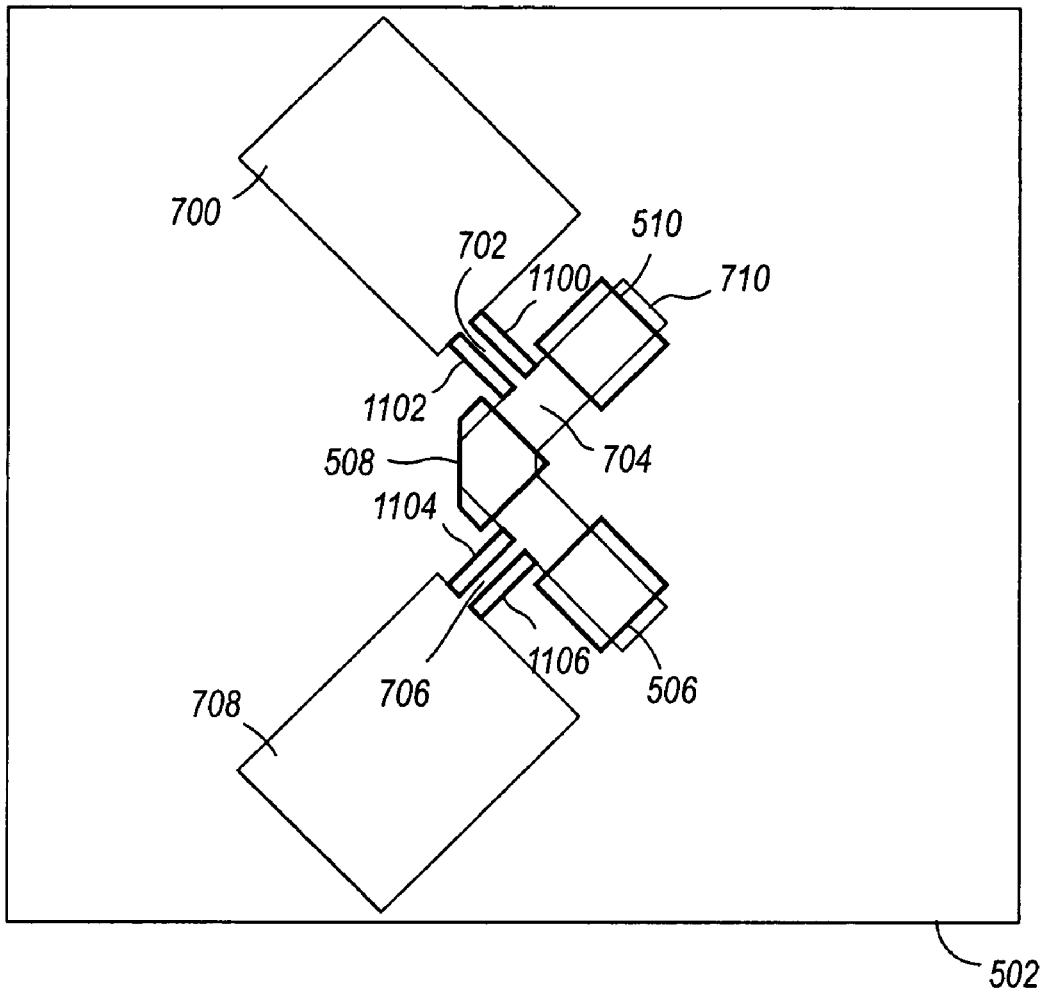
FIGS. 11 & 12 illustrate alternate embodiments of the switch shown in FIG. 5.

Another way to cause an actuating fluid 714 to exert a force is to decrease the size of the cavities 700, 702 that hold the actuating fluid 714. FIG. 11 therefore illustrates an alternative embodiment of the switch 500, wherein heater resistors 800, 802 are replaced with a number of piezoelectric elements 1100, 1102, 1104, 1106 that deflect into cavities 302, 306 when voltages are applied to them. If voltages are alternately applied to the piezoelectric elements 1100, 1102 exposed within cavity 702, and the piezoelectric elements 1104, 1106 exposed within cavity 706, alternate forces can be applied to the switching fluid 712, causing it to assume one of two different switching states. Additional details on how to actuate a fluid-based switch by means of piezoelectric pumping are described in U.S. patent application Ser. No. 10/137,691 of Marvin Glenn Wong filed May 2, 2002 and entitled "A Piezoelectrically Actuated Liquid Metal Switch", which is hereby incorporated by reference.

Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity.

To enable faster cycling of the afore-mentioned heater resistors 800, 802 or piezoelectric elements 1100–1106, each may be coupled between a pair of planar conductors 530/526, 532/528. As shown in FIG. 5, some of these planar conductors 526, 528 may be the planar ground conductors that run adjacent to the planar signal conductors 512–516. Others of the conductors 530, 532 may be coupled to conductors 546, 548 of the second metal layer 602 by means of vias 550, 552 so that they may pass under the lid 608.

Figure 12:
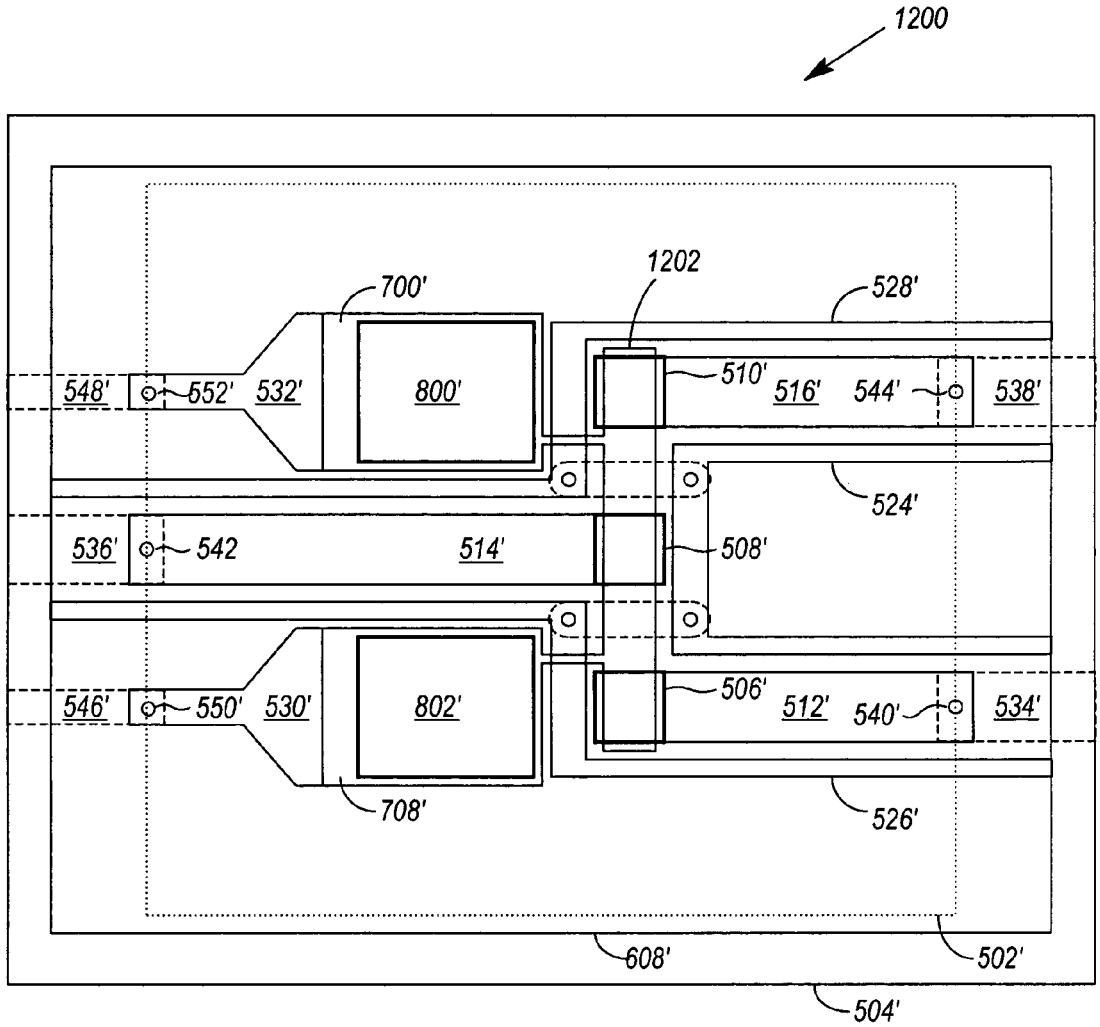

Although the switching fluid channel 710 shown in FIGS. 5, 7 & 8 comprises a bend, the channel need not. A switch 1200 comprising a straight switching channel 1202 is shown in FIG. 12 (other elements shown in FIG. 12 correspond to elements shown in FIG. 5, and are referenced by the prime (') of the reference numbers used in FIG. 5—i.e., 502'–532', 700', 708', 800' & 802'). If a bent switching fluid channel 710 is used, one planar signal conductor 514 may present within the cavity 710 defined by the switching fluid channel 710 "at" the bend, and additional ones of the planar signal conductors 512, 516 may present within the cavity 710 "on either side of" the bend. An advantage provided by the bent switching fluid channel 710 is that signals propagating over the switching fluid 712 held therein need not take right angle turns.

To make it easier to couple signal routes to the switch 500, it may be desirable to group signal inputs on one side of the switch, and group signal outputs on another side of the switch. If this is done, it is preferable to limit the tightest corner taken by a path of any of the planar signal conductors to less than 90°, or more preferably to about 45°, and even more preferably to less than 45° (i.e., to reduce the number of signal reflections at conductor corners).

Although the above description has been presented in the context of the switches 100, 300, 500 1200 shown and described herein, application of the inventive concepts is not limited to the fluid-based switches shown herein, and may be applied to other fluid-based switches, or even non-fluid-based switches (e.g., switches having spring-biased metal strips, magnetic-biased metal strips or optical components as their switching elements).

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) a switching fluid;

b) a substrate having internal and external metal layers separated by at least an insulating layer; the external metal layer comprising a first plurality of signal conductors, at least some of which are in contact with the switching fluid; the insulating layer comprising a first plurality of vias; the internal metal layer comprising a second plurality of signal conductors, electrically coupled to the first plurality of signal conductors by the first plurality of conductive vias; and c) a lid, attached to the substrate to encapsulate the first plurality of signal conductors between the lid and the substrate.

2. The switch of claim 1, wherein the external metal layer of the substrate further comprises a ground trace, and wherein the lid is conductive and is attached to the ground trace.

3. The switch of claim 2, wherein the lid is soldered to the ground trace.

4. The switch of claim 2, wherein the lid is attached to the ground trace via a conductive adhesive.

5. The switch of claim 2, wherein the ground trace follows the perimeter of the lid.

6. The switch of claim 1, wherein the external metal layer further comprises a number of ground conductors, adjacent either side of at least those of the first plurality of signal conductors in contact with the switching fluid.

7. The switch of claim 6, wherein the lid is conductive, and wherein the ground conductors are electrically coupled to the lid.

8. The switch of claim 1, wherein:

a) the external metal layer further comprises a plurality of contacts, exterior to the lid; and b) the insulating layer further comprises a second plurality of conductive vias coupling the second plurality of signal conductors to the plurality of contacts.

9. A switch, comprising:

a) first and second mated substrates defining therebetween at least portions of a number of cavities, the first substrate comprising first and second metal layers separated by at least an insulating layer;

b) a switching fluid, held within one or more of the cavities, that is movable between at least first and second switch states in response to forces that are applied to the switching fluid;

c) a lid, attached to the first metal layer and covering at least a portion of the second substrate; and d) a first plurality of signal conductors formed in the first metal layer, in contact with the switching fluid; and a second plurality of signal conductors formed in the second metal layer, extending under the lid, and electrically coupled to the first plurality of signal conductors by a plurality of conductive vias formed in the insulating layer.

10. The switch of claim 9, wherein:

a) the second substrate is a channel plate; and b) the one or more cavities holding the switching fluid are at least partly defined by a bent switching fluid channel in the channel plate.

11. The switch of claim 10, wherein:

a) one of the signal conductors is present within the cavity defined by the bent switching fluid channel, at the bend; and b) different ones of the signal conductors are present within the cavity defined by the bent switching fluid channel, on either side of the bend.

12. The switch of claim 9, wherein the first metal layer of the substrate further comprises a ground trace, and wherein the lid is conductive and is attached to the ground trace.

13. The switch of claim 12, wherein the lid is soldered to the ground trace.

14. The switch of claim 12, wherein the lid is attached to the ground trace via a conductive adhesive.

15. The switch of claim 12, wherein the ground trace follows a perimeter of the lid.

16. The switch of claim 9, wherein the first metal layer further comprises a number of ground conductors, adjacent either side of each of the first plurality of signal conductors.

17. The switch of claim 16, wherein the lid is conductive, and wherein the ground conductors are electrically coupled to the lid.

18. The switch of claim 9, wherein:

a) the first metal layer further comprises a plurality of contacts, exterior to the lid; and b) the insulating layer further comprises a second plurality of conductive vias coupling the second plurality of signal conductors to the plurality of contacts.

19. A switch, comprising:

a) a switching element;

b) a substrate having internal and external metal layers separated by at least an insulating layer; the external metal layer comprising a first plurality of signal conductors, at least some of which are in contact with the switching element; the insulating layer comprising a first plurality of vias; the internal metal layer comprising a second plurality of signal conductors, electrically coupled to the first plurality of signal conductors by the first plurality of conductive vias; and c) a lid, attached to the substrate to encapsulate the first plurality of signal conductors between the lid and the substrate.

20. The switch of claim 19, further comprising an adhesive between said lid and said substrate.

* * * * *

UNITED STATES PATENT AND TRADEMARK OFFICE

CERTIFICATE OF CORRECTION

PATENT NO. : 7,019,236 B2
APPLICATION NO. : 10/799006
DATED : March 28, 2006
INVENTOR(S) : Dove It is certified that error appears in the above-identified patent and that said Letters Patent is hereby corrected as shown below:

TITLE page, ITEM (75), "Inventor", insert - -; John R. Lindsey, Colorado Springs, CO (US) - -.

On the face page, in field (56), under "Other Publications", in column 2, line 16, after "drawings," insert - - Attorney Docket No. 10020703-1, - -.

In column 7, line 10, in Claim 5, delete "the perimeter" and insert - - a perimeter - -, therefor.

Signed and Sealed this

Twenty-ninth Day of August, 2006

JON W. DUDAS
*Director of the United States Patent and Trademark Office*